US009700994B2

(12) United States Patent
Nakayama et al.

(10) Patent No.: US 9,700,994 B2
(45) Date of Patent: Jul. 11, 2017

(54) CIRCULAR SUPPORT PLATE, NONWOVEN FABRIC POLISHING ROLL, ROLL ASSEMBLY, AND POLISHING METHOD

(71) Applicant: 3M INNOVATIVE PROPERTIES COMPANY, St. Paul, MN (US)

(72) Inventors: Masashi Nakayama, Sagamihara (JP); Yuji Ohnuma, Murayama (JP)

(73) Assignee: 3M Innovative Properties Company, St. Paul, MN (US)

( * ) Notice: Subject to any disclaimer, the term of this patent is extended or adjusted under 35 U.S.C. 154(b) by 180 days.

(21) Appl. No.: 14/654,124

(22) PCT Filed: Dec. 19, 2013

(86) PCT No.: PCT/US2013/076561

§ 371 (c)(1),
(2) Date: Jun. 19, 2015

(87) PCT Pub. No.: WO2014/105636

PCT Pub. Date: Jul. 3, 2014

(65) Prior Publication Data

US 2015/0314423 A1 Nov. 5, 2015

(30) Foreign Application Priority Data

Dec. 27, 2012 (JP) ..... 2012-284547

(51) Int. Cl.

| | |
|---|---|
| ***B24D 13/00*** | (2006.01) |
| ***B24D 13/08*** | (2006.01) |
| ***B24B 29/00*** | (2006.01) |

(52) U.S. Cl.
CPC ..... *B24D 13/08* (2013.01); *B24B 29/00* (2013.01)

(58) Field of Classification Search
CPC ..... B24D 13/02; B24D 13/04; B24D 13/08; B24D 13/10; B24D 18/0009; B24D 18/0072; B24B 29/00; Y10T 156/10
(Continued)

(56) References Cited

U.S. PATENT DOCUMENTS 3,991,526 A * 11/1976 Frank ..... B24D 13/08 15/230.15
5,127,123 A * 7/1992 Belanger ..... B60S 3/042 15/181

(Continued)

FOREIGN PATENT DOCUMENTS

CN 200967176 Y 10/2007
CN 201168925 Y 12/2008

(Continued)

*Primary Examiner* — George Nguyen
(74) *Attorney, Agent, or Firm* — David B. Patchett

(57) ABSTRACT

A nonwoven fabric polishing roll having a through hole into which a rotating shaft of a polishing machine is inserted, that includes a polishing portion formed by stacking a plurality of circular nonwoven fabrics having an aperture that forms the through hole; and two circular support plates located one at each of both ends in the stacking direction of the polishing portion, having an aperture that forms the through hole, and having an external diameter that is substantially the same as that of the circular non-woven fabric; wherein, the circular support plates include nonwoven fabric that is hardened in a compressed state.

10 Claims, 9 Drawing Sheets

(58) Field of Classification Search
USPC ..... 451/56
See application file for complete search history.

(56) References Cited

U.S. PATENT DOCUMENTS

| | | | | |
|---|---|---|---|---|
| 5,560,744 | A | 10/1996 | Schaffner, III | |
| 5,765,256 | A * | 6/1998 | Allan | A46B 13/001 15/230 |
| 5,989,105 | A | 11/1999 | Kawakawaguchi | |
| 5,996,167 | A * | 12/1999 | Close | B24D 3/28 15/230.12 |
| 6,103,160 | A * | 8/2000 | Uchida | B28B 1/008 264/112 |
| 6,179,887 | B1 * | 1/2001 | Barber, Jr. | A46B 3/005 451/527 |
| 6,863,596 | B2 | 3/2005 | Fritz | |
| 9,248,551 | B2 * | 2/2016 | Nakayama | |
| 2003/0096566 | A1 | 5/2003 | Fritz | |
| 2005/0153558 | A1 * | 7/2005 | Koh | A46B 3/005 438/692 |
| 2013/0180645 | A1 * | 7/2013 | Kost | B24D 13/10 156/95 |
| 2014/0038502 | A1 * | 2/2014 | Nakayama | B24D 13/08 451/529 |

FOREIGN PATENT DOCUMENTS

| | | |
|---|---|---|
| FR | 550 823 | 3/1923 |
| JP | 57-43966 | 8/1955 |
| JP | 58-27061 | 8/1956 |
| JP | 56-95581 | 8/1981 |
| JP | 57-008082 | 1/1982 |
| JP | 60-8936 | 3/1985 |
| JP | 2009-136972 | 6/2009 |
| WO | WO 97/27029 | 7/1997 |
| WO | WO 2012/106173 | 8/2012 |

* cited by examiner

CIRCULAR SUPPORT PLATE, NONWOVEN FABRIC POLISHING ROLL, ROLL ASSEMBLY, AND POLISHING METHOD

CROSS REFERENCE TO RELATED APPLICATIONS

This application is a national stage filing under 35 U.S.C. 371 of PCT/US2013/076561 filed Dec. 19, 2013, which claims priority to Japanese Patent Application No. 2012-284547, filed Dec. 27, 2012, the disclosures of which are incorporated by reference in their entirety herein.

FIELD OF INVENTION

The present invention relates to a circular support plate, a nonwoven fabric polishing roll, a roll assembly, and a polishing method.

BACKGROUND ART

Conventionally, a cylindrical polishing roll in which a through hole is formed into which a rotating shaft (spindle) of a rotating tool is inserted is used as a polishing roll for polishing a surface of metal strip and the like (for example, Patent Document 1). Laminated forms, flap forms, and convoluted forms of these polishing rolls, as illustrated in FIG. 5 of Patent Document 1, for example, are known as this type of polishing roll.

Of these, in the laminated form, normally hard disk plates such as metal or the like are disposed on both ends of disk sheet compression laminates, to support the compression laminates as illustrated in FIG. 1 of Patent Document 1.

Patent Document 1: Japanese Unexamined Patent Application Publication No. H9-201232

SUMMARY OF THE INVENTION

In the laminated form of polishing roll as disclosed in FIG. 1 of Patent Document 1, the compression laminates of the disk sheets have a greater external diameter than the disc plates, and this produces the problem that the disk sheets open out in the so-called "flower opening" manner. If this flower opening occurs excessively, differences in density occur along the stacking direction of the compression laminate, and the polishing process can become inefficient and non-uniform.

Also, the limiting usable diameter of the polishing roll is determined by the external diameter of the disc plate, so if large external diameter disc plates are used to support the compression laminates and suppress the flower opening, the limiting usable diameter becomes larger, and the life of the polishing roll becomes shorter.

One aspect of the present invention relates to a nonwoven fabric polishing roll having a through hole into which is inserted a rotating shaft of a polishing machine. The nonwoven fabric polishing roll includes a polishing portion formed by stacking a plurality of circular nonwoven fabrics having an aperture that forms the through hole; and two circular support plates located one at each of both ends in the stacking direction of the polishing portion, having an aperture that forms the through hole, and having an external diameter that is substantially the same as that of the circular nonwoven fabric. In the nonwoven fabric polishing roll, the circular support plates include nonwoven fabric that is hardened in a compressed state.

In this nonwoven fabric polishing roll, the circular support plates that support the polishing portion have an external diameter that is substantially the same as that of the circular nonwoven fabrics that constitute the polishing portion, so the spread (in other words, the flower opening) in the stacking direction of the circular nonwoven fabrics in the polishing portion is sufficiently suppressed. Therefore, the polishing portion has a density that is uniform in the stacking direction, so it is possible to achieve highly efficient and uniform polishing processes.

Also, in the nonwoven fabric polishing roll, the circular support plate includes nonwoven fabric that has been hardened in the compressed state, so the circular support plate can wear together with the polishing portion in the polishing process. In other words, in the nonwoven fabric polishing roll, the limiting usable diameter does not depend on the external diameter of the circular support plate, so it is possible to carry out the polishing process for a long period of time compared with a conventional polishing roll.

In one embodiment, a deformation rate in the thickness direction of the circular support plate with respect to compressive stress $T_1/S_1$ ($N/m^2$) is not more than 20%. Here, the compressive stress $T_1/S_1$ is the compressive stress per unit area calculated from an area of the circular support plate contacting a flange $S_1$ ($m^2$) and the compressive stress applied from the polishing portion $T_1$ (N). Also, the flange is a member that joins the nonwoven fabric polishing roll and the rotating shaft. In the nonwoven fabric polishing roll that includes the circular support plate with this deformation rate, the spread in the stacking direction of the circular nonwoven fabric in the polishing portion is further significantly suppressed.

In one embodiment, the nonwoven fabric included in the circular support plate is hardened by an adhesive, and a content of the adhesive is in a range from 5 to 30 mass % of the nonwoven fabric. The circular support plate that includes such nonwoven fabric can easily satisfy the deformation rate described above. Also, the circular support plate can have a sufficiently large amount of wear in the polishing process, so according to this circular support plate, it is possible to perform the polishing process more efficiently.

In one embodiment, a thickness of the circular support plate is in a range from 3 to 25% of the external diameter of the circular support plate. According to this circular support plate, the effective polishing width of the nonwoven fabric polishing roll is sufficiently ensured, and the spread in the stacking direction of the circular nonwoven fabric in the polishing portion is more significantly suppressed.

In one embodiment, the circular support plate includes a laminate that has been hardened while compressed in the stacking direction, and the laminate includes a plurality of stacked circular nonwoven fabrics. The circular support plate is formed from circular nonwoven fabric that is the same as the circular nonwoven fabric that forms the polishing portion, that is hardened in the compressed state, so the amount of wear in polishing processes is the same as that of the polishing portion. Therefore, even if the circular nonwoven fabric contacts an object to be polished or a backup roll during the polishing process, they are difficult to wear or degrade, so it is possible to more efficiently perform the polishing process. A backup roll has the role of supporting the object to be polished on a surface on a side opposite a polishing surface of the object to be polished, in a polishing machine.

In one embodiment, the polishing portion may include a plurality of stacked circular plates having an aperture that forms the through hole, and an external diameter that is not greater than the external diameter of the circular nonwoven fabrics.

Also, the circular plates may include nonwoven fabric that is hardened in the compressed state, and in this case, the external diameter of the circular plates may be substantially the same as the external diameter of the circular nonwoven fabric.

A second aspect of the present invention relates to a roll assembly that includes the nonwoven fabric polishing roll described above, a rotating shaft that is inserted into the through hole, and two flanges that join the rotating shaft and the nonwoven fabric polishing roll at both ends of the nonwoven fabric polishing roll.

This roll assembly includes the nonwoven fabric polishing roll described above, so it has a polishing portion with a uniform density, and is capable of performing highly efficient and uniform polishing processes. Also, in this roll assembly, the circular support plates can wear together with the polishing portion during polishing processes, so, for example, it is possible to carry out the polishing process down to the external diameter of the flange, and it is possible to perform the polishing processes for a long period of time compared with a conventional polishing roll.

A third aspect of the present invention relates to a circular support plate located at an end portion of a polishing portion in a nonwoven fabric polishing roll that includes a polishing portion formed by stacking a plurality of circular nonwoven fabrics having an aperture that forms a through hole into which a rotating shaft of a polishing machine is inserted, wherein the circular support plate comprises an aperture that forms the through hole, the circular support plate has an external diameter that is substantially the same as that of the circular nonwoven fabrics, and the circular support plate includes a nonwoven fabric that is hardened in a compressed state.

This circular support plate is disposed at an end portion of the polishing portion in the nonwoven fabric polishing roll, so it is possible to suppress the spread in the stacking direction of the polishing portion. Also, the circular support plate can wear together with the polishing portion during polishing processes, so it is possible to suppress the spread without increasing the limiting usable diameter of the nonwoven fabric polishing roll. In other words, according to this circular support plate, it is possible to achieve a nonwoven fabric polishing roll that is capable of highly efficient and uniform polishing over a long period of time.

A fourth aspect of the present invention relates to a polishing method that includes a step of bringing an object to be polished into contact with the polishing portion of the roll assembly as described above that is rotated by the rotating shaft.

In this polishing method, the roll assembly described above is used, so it is possible to perform highly efficient and uniform polishing processes over a long period of time. Therefore, according to this polishing method, it is possible to highly efficiently obtain a uniformly polished object to be polished.

The present invention provides a nonwoven fabric polishing roll that is capable of highly efficient and uniform polishing over a long period of time, a circular support plate to achieve this nonwoven fabric polishing roll, a roll assembly that includes the nonwoven fabric polishing roll, and a polishing method using the roll assembly.

DETAILED DESCRIPTION OF THE INVENTION

Figure 1:
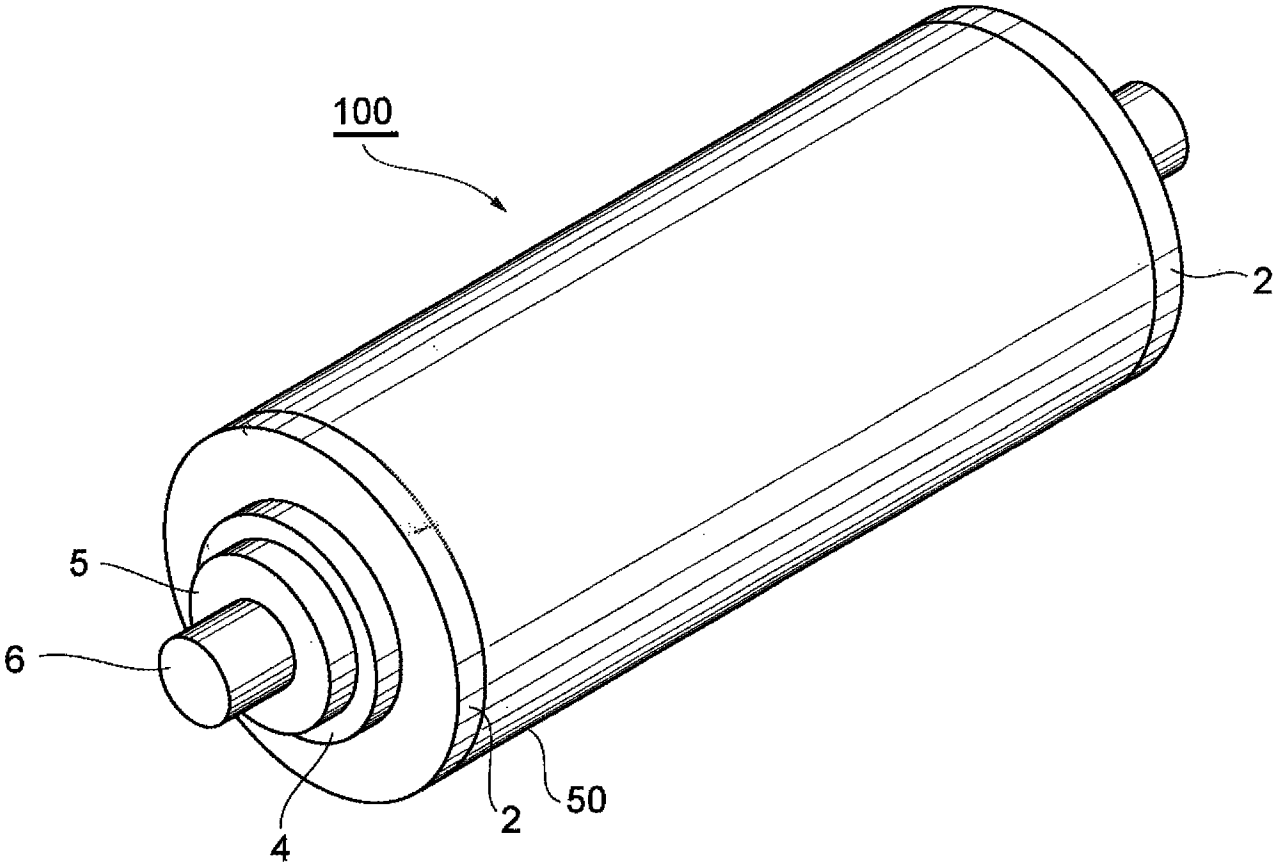
FIG. 1 illustrates an assembly with a rotating shaft inserted into a nonwoven fabric polishing roll according to an embodiment of the present invention.

The following is a detailed explanation of the preferred embodiments of the present invention, with reference to the drawings. In the following explanation, the same or corresponding elements are given the same reference numeral, and duplicate explanations are omitted.

Figure 2:
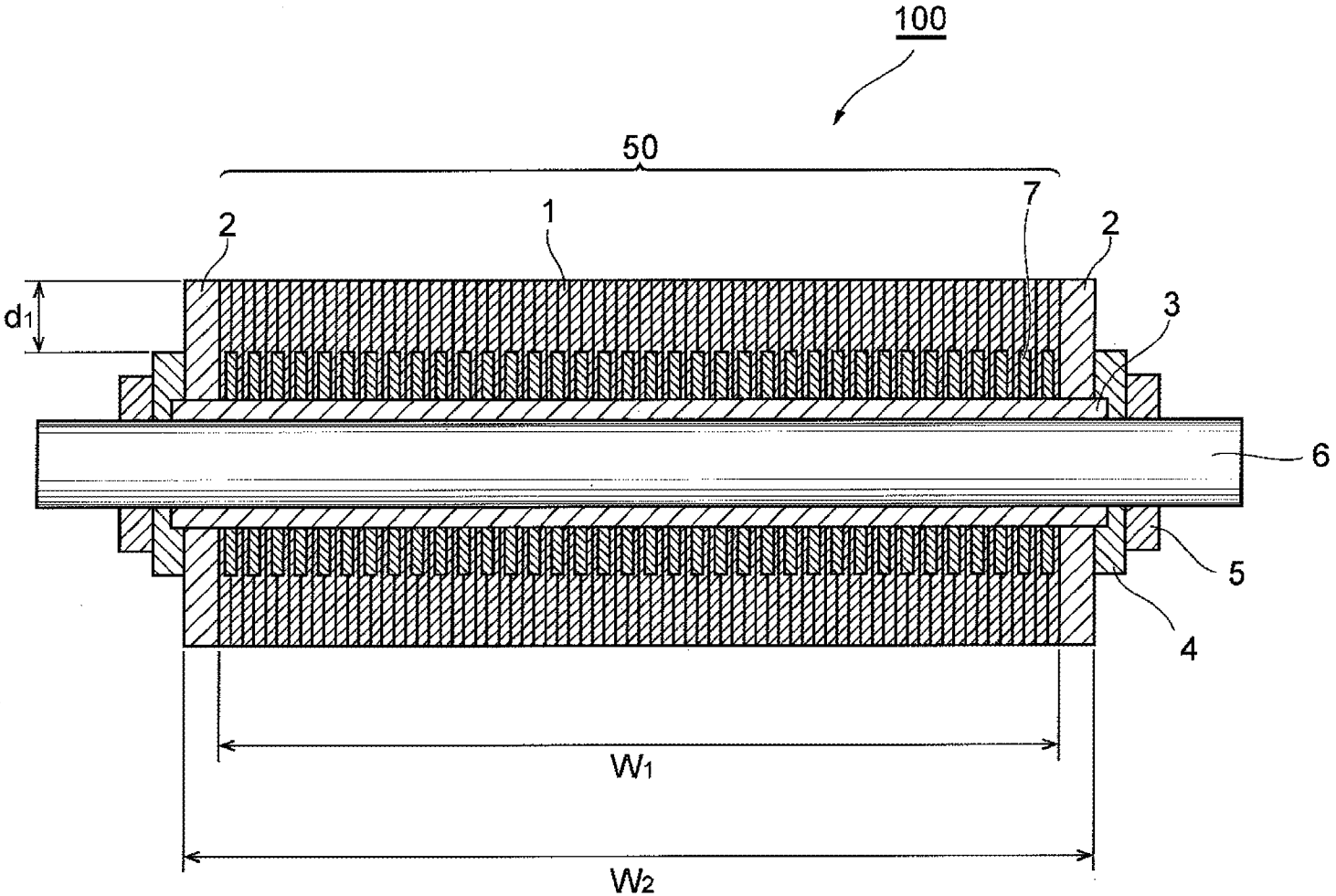
FIG. 2 is a schematic cross-sectional view illustrating an assembly with the rotating shaft inserted into the nonwoven fabric polishing roll according to an embodiment of the present invention.

FIGS. 1 and 2 illustrate an assembly in which a rotating shaft 6 is inserted into a nonwoven fabric polishing roll 100 according to a first embodiment of the present invention. This whole assembly may also be referred to as a roll assembly.

The nonwoven fabric polishing roll 100 includes a polishing portion 50 in which a plurality of circular nonwoven fabrics 1 is stacked, and two circular support plates 2 located at both ends in the stacking direction of the polishing portion 50. The nonwoven fabric polishing roll 100 includes a through hole in which the rotating shaft 6 is inserted, and is fixed to the rotating shaft 6 by a flange 4 and a lock nut 5.

The rotating shaft 6 has key projections 3 to transmit torque from a polishing machine to the nonwoven fabric polishing roll 100, and the through hole of the nonwoven fabric polishing roll 100 has a shape to engage with the rotating shaft 6 including the key projections 3.

In the nonwoven fabric polishing roll 100, the circular support plate 2 has an external diameter that is substantially the same as that of the circular nonwoven fabric 1. Therefore, in the nonwoven fabric polishing roll 100, the spread in the stacking direction of the circular nonwoven fabric 1 in the polishing portion 50 (in other words, the flower opening) is sufficiently suppressed. Also, the polishing portion 50 in which the flower opening is sufficiently suppressed has a uniform density in the stacking direction, so highly efficient and uniform polishing can be achieved.

Also, in the nonwoven fabric polishing roll 100, the circular support plate 2 includes nonwoven fabric that is hardened in the compressed state, so it can wear together with the polishing portion 50 in the polishing process.

Therefore, the nonwoven fabric polishing roll 100 can perform the polishing process over a range of thickness indicated by $d_1$ in FIG. 2, so it is capable of performing the polishing process over a long period of time compared with a conventional polishing roll.

Figure 8:
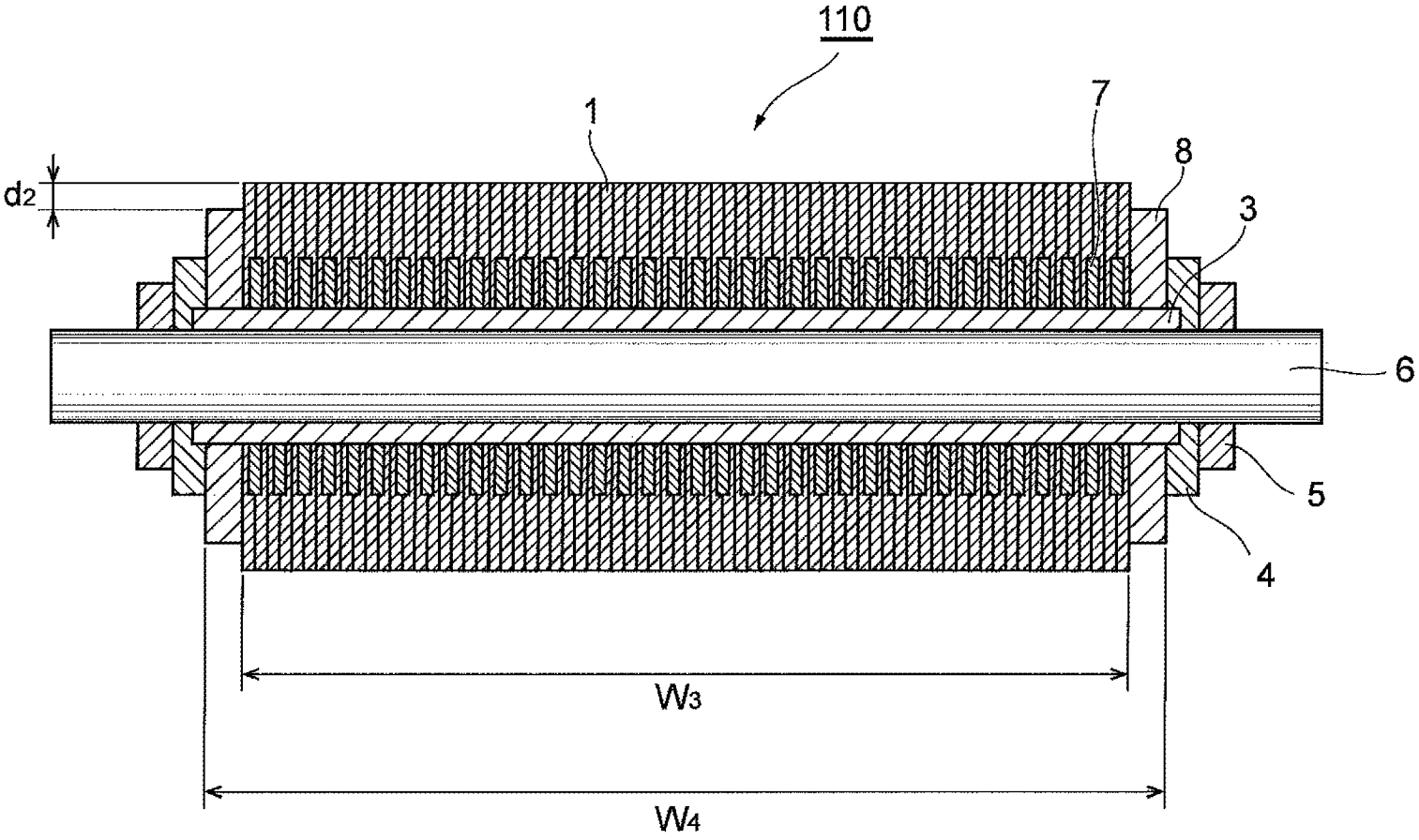
FIG. 8 illustrates an example of nonwoven fabric polishing roll in which a polishing portion is supported by conventional disc plates.

The conventional nonwoven fabric polishing roll 110 illustrated in FIG. 8 is a schematic cross-sectional view illustrating a structure in which the circular support plate 2 of the nonwoven fabric polishing roll 100 is replaced with a conventional hard disc 8. In the nonwoven fabric polishing roll 110, the spread of the circular nonwoven fabric 1 in the stacking direction is suppressed by the hard disc 8. However, the external diameter of the hard disc 8 is less than that of the circular nonwoven fabric 1, so, in some cases, it is not possible to achieve sufficient suppression of the spread. Normally, a plastic disc, a laminated timber disk, a metal disc, or the like is used for the hard disc 8.

Also, in the nonwoven fabric polishing roll 110, when the polishing portion wears and the external diameter becomes the same as that of the hard disc 8, the hard disc 8 contacts an object to be polished or a backup roll, so it is not possible to carry out the polishing process. In other words, in the nonwoven fabric polishing roll 110, it is only possible to perform the polishing process over the range of thickness indicated by $d_2$ in FIG. 8.

It is possible to suppress the spread in the stacking direction of the circular nonwoven fabric 1 by, for example, hardening the overall polishing portion 50 using an adhesive, or the like, but, with this method, the polishing portion 50 would become rigid with a high hardness. Such a polishing portion 50 could be ideally applied for polishing applications requiring high polishing load and high polishing volume. However, for polishing applications under low polishing load conditions where an ability to accommodate the object to be polished is required, it may be difficult to obtain a uniform finish.

In contrast, in the nonwoven fabric polishing roll 100 according to this embodiment, it is possible to effectively suppress the spread of the circular nonwoven fabric 1 in the stacking direction, without hardening the overall polishing portion. Therefore, the nonwoven fabric polishing roll 100 can be ideally applied to polishing under low polishing load conditions with polishing loads in a range from 0.1 to 10 kgf/cm (preferably from 0.5 to 5 kgf/cm).

In the nonwoven fabric polishing roll 100, it is possible to perform the polishing process over a width indicated by $W_1$ in FIG. 2. Also, in the nonwoven fabric polishing roll 100, the circular support plate 2 may include polishing abrasive particles so that it can perform the polishing process on the object to be polished together with the polishing portion 50. In this case, the nonwoven fabric polishing roll 100 is capable of performing the polishing process over a width indicated by $W_2$ in FIG. 2. In contrast, in the nonwoven fabric polishing roll 110, it is only possible to perform the polishing process with the polishing portion.

In the nonwoven fabric polishing roll 100, the polishing portion 50 includes the plurality of circular nonwoven fabrics 1, and a plurality of circular plates 7 having an external diameter less than the external diameter of the circular nonwoven fabrics 1. The plurality of circular nonwoven fabrics 1 and the plurality of circular plates 7 are stacked at substantially equal intervals so that two circular nonwoven fabrics 1 are sandwiched by two circular plates 7.

Here, the circular plates 7 have an external diameter less than the external diameter of the circular nonwoven fabrics 1, and have an aperture that form the through hole together with the circular nonwoven fabrics 1 into which the rotating shaft 6 is inserted, also the compression deformation rate with respect to compression forces from directions normal to the stacking direction is less than that of the circular nonwoven fabrics 1. The circular plate 7 has the effect of sufficiently supporting the torque from the rotating shaft 6 applied to the inner periphery of the polishing portion 50, and properly transmitting it to the outer periphery of the polishing portion 50. Therefore, in the polishing portion 50 that includes the circular plates 7, the shape of the outer periphery that contacts the object to be polished is stable, so a more uniform polishing process is possible.

In the nonwoven fabric polishing roll 100, there may be a plurality of stacked circular nonwoven fabrics 1 in the polishing portion 50, but the circular plate 7 does not necessarily have to be provided in the polishing portion 50. In other words, the polishing portion 50 may be formed by stacking the plurality of circular nonwoven fabrics 1.

In FIG. 2, in the polishing portion 50, two circular plates 7 are stacked sandwiching two circular nonwoven fabrics 1, but the stacking form is not limited thereto. For example, the circular plates 7 may be stacked sandwiching a single circular nonwoven fabric 1, or they may be stacked sandwiching three or more circular nonwoven fabrics 1.

Also, it is not necessary to stack the circular plates 7 at equal intervals. For example, there may be locations in the polishing portion 50 where the circular plates 7 are stacked sandwiching a single circular nonwoven fabric 1, and locations where they are stacked sandwiching two or more circular nonwoven fabrics 1. Preferably, the circular plates 7 are stacked at substantially equal intervals, so that the polishing performance in the stacking direction is still more uniform. Here, substantially equal intervals means, for example, that a plurality of circular plates 7 is stacked so that they each sandwich the same number of circular nonwoven fabrics 1.

The external diameter of the circular plate 7 may be less than the external diameter of the flange 4. Depending on the circumstances, the limiting usable diameter of the nonwoven fabric polishing roll 100 depends on the greater of the external diameter of the circular plates 7 and the external diameter of the flange 4. When the external diameter of the circular plates 7 is greater than the external diameter of the flange 4, it is difficult to visually check the limiting usable diameter. On the other hand, when the external diameter of the circular plates 7 is less than the external diameter of the flange 4, it is possible to visually check the limiting usable diameter based on the external diameter of the flange 4.

When the circular plates 7 include nonwoven fabric that is hardened in the compressed state, as described later, so that they can wear in the polishing process together with the circular nonwoven fabrics 1, the external diameter of the circular plates 7 may be greater than the external diameter of the flange 4. When such circular plates 7 are used, even when the external diameter of the circular plates 7 is greater than the external diameter of the flange 4, the polishing process can be performed until the external diameter of the circular plates 7 reach the external diameter of the flange 4.

The total thickness of circular plates 7 per meter length of the polishing portion 50 in the stacking direction is preferably in a range from 10 to 70 cm, and more preferably in a range from 15 to 50 cm. By stacking the circular plates at this rate, it is possible to obtain a significantly more uniform polishing performance at the outer periphery. To realize this total thickness, the number of stacked circular plates 7 may be, for example, in a range from 50 to 350 per meter length in the stacking direction of the polishing portion 50, when the thickness of the circular plate 7 is 2 mm.

In the polishing portion 50, the plurality of circular nonwoven fabrics 1 is stacked, but the circular nonwoven fabrics 1 may be compressed as desired in the stacking direction. The degree of compression can be varied as appropriate in accordance with the application of the nonwoven fabric polishing roll (the type of object to be polished, and the like), and, by varying the degree of compression, the nonwoven fabric density can be varied as desired within an area of the polishing portion that can be used for polishing (a thickness range indicated by $d_1$ in FIG. 2, or a range to the outer side of the limiting usable diameter.).

The nonwoven fabric density in the area of the polishing portion 50 that can be used for polishing is preferably in a range from 0.05 to 1.00 g/cm$^3$, and more preferably in a range from 0.1 to 0.7 g/cm$^3$. The nonwoven fabric density can be determined by measuring the mass of nonwoven fabric per unit volume.

The plurality of compressed circular nonwoven fabrics 1 is supported by the circular support plates 2 at both ends of the polishing portion 50, so that the shape is maintained. The circular support plates 2 receive the compressive stress of the circular nonwoven fabrics 1 from surfaces on the polishing portion side, and applies the load of the compressive stress to the flanges 4 on the surface on the side opposite the polishing portion.

Here, the compressive stress per unit area applied to the circular support plates 2 can be determined from $T_1/S^1$ (N/cm$_2$) where an area of a contact surface between the circular support plate 2 and the flange 4 is $S_1$ (m$_2$), and compressive stress applied to the circular support plate 2 from the polishing portion 50 is $T^1$ (N).

The deformation rate in the thickness direction of the circular support plate 2 with respect to this compressive stress per unit area $T_1/S_1$ (N/cm$^2$) is preferably 20% or less, and more preferably is 10% or less. By making the deformation rate of the circular support plate 2 sufficiently small, the deformation of the circular support plate 2 due to the compressive stress from the polishing portion 50 is suppressed sufficiently, and, as a result, the spread of the circular nonwoven fabric 1 in the stacking direction is further properly suppressed.

In the polishing portion 50, the plurality of stacked circular nonwoven fabrics 1 may be hardened using an adhesive or the like and integrated with each other while compressed in the stacking direction. In this case, it is not necessary that the deformation rate of the circular support plates 2 be 20% or less as described above, and it is possible to select circular support plates 2 with any desired deformation rate in accordance with the hardened state of the polishing portion 50.

Figure 3A:
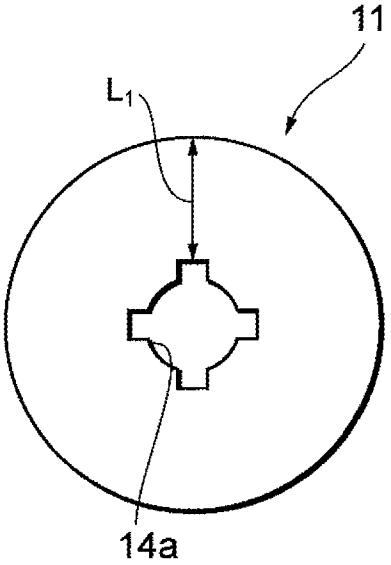
FIGS. 3A-C illustrate examples of circular support plates that are adapted for use with the nonwoven fabric polishing roll according to an embodiment of the present invention.
Figure 3B:
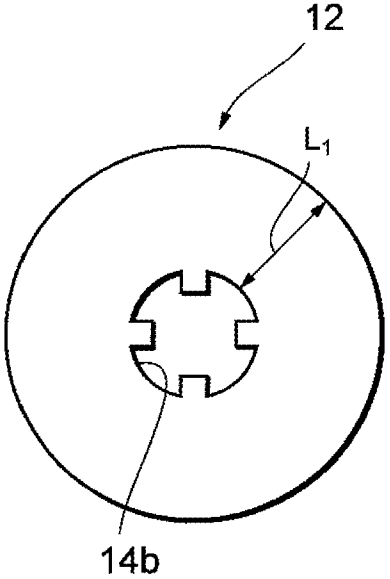
Figure 3C:
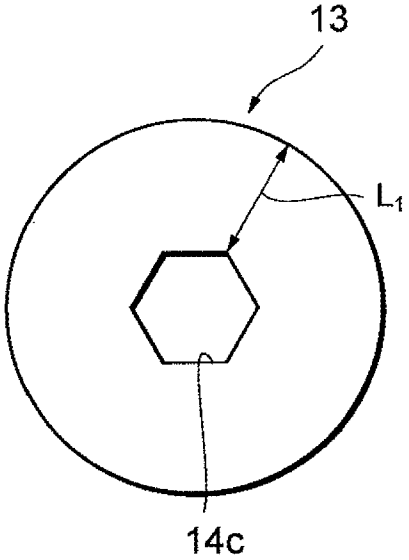
Figure 4A:
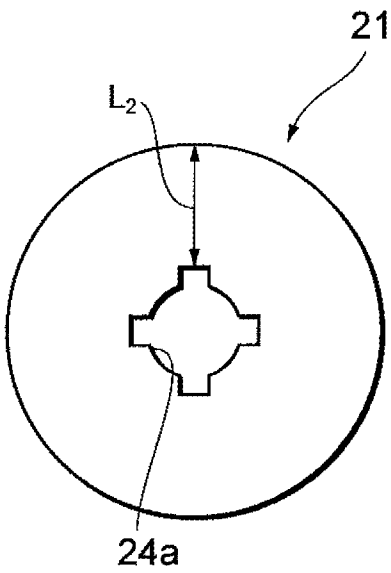
FIGS. 4A-C illustrate examples of circular nonwoven fabrics that are adapted for use with the nonwoven fabric polishing roll according to an embodiment of the present invention.
Figure 4B:
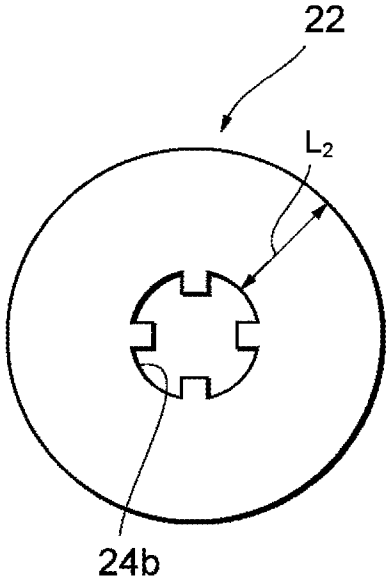
Figure 4C:
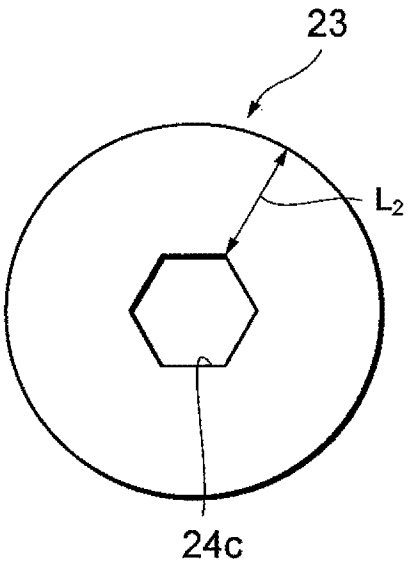
Figure 5C:
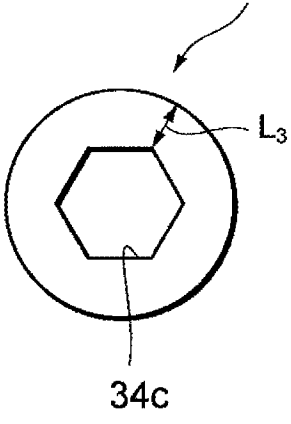
FIGS. 5A-C illustrate examples of circular plates that are adapted for use with the nonwoven fabric polishing roll according to an embodiment of the present invention.
Figure 5B:
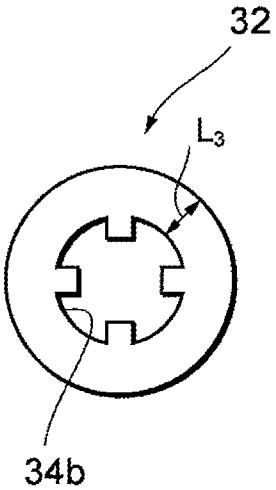
Figure 5A:
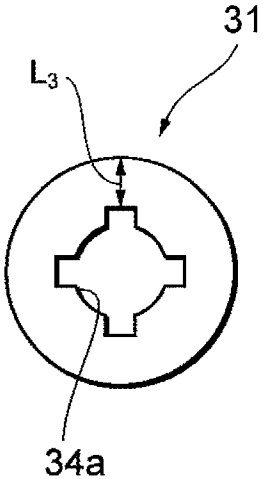

FIGS. 3A-C illustrate examples of several forms of the circular nonwoven fabric 1, FIGS. 4A-C illustrate examples of several forms of the circular support plate 2, and FIGS. 5A-C illustrate examples of several forms of the circular plate 7.

A circular nonwoven fabric 11 in FIG. 3A is used in combination with a circular support plate 21 in FIG. 4A, and, when necessary, is further used in combination with a circular plate 31 in FIG. 5A. The circular nonwoven fabric 11 has an aperture 14*a* in the center, the circular support plate 21 has an aperture 24*a* in the center, and the circular plate 31 has an aperture 34*a* in the center.

The aperture 14*a*, the aperture 24*a*, and the aperture 34*a* have substantially the same shape. In the nonwoven fabric polishing roll in which the circular support plates 21 are disposed at both ends of the polishing portion in which a plurality of each of the circular nonwoven fabric 11 and the circular plate 31 are stacked, the through hole into which the rotating shaft of the polishing machine is inserted is formed by the aperture 14*a*, the aperture 24*a*, and the aperture 34*a*. In other words, the aperture 14*a*, the aperture 24*a*, and the aperture 34*a* have substantially the same shape as the cross-sectional shape of the rotating shaft of the polishing machine, and they can each have key grooves that engage with the key projections on the rotating shaft.

The external diameter of the circular nonwoven fabric 11 and that of the circular support plate 21 are substantially the same, and the shortest distance $L_1$ from the aperture 14*a* to the outer periphery of the circular nonwoven fabric 11 and the shortest distance $L_2$ from the aperture 24*a* to the outer periphery of the circular support plate 21 are substantially the same length. On the other hand, the shape of the aperture 34*a* of the circular plate 31 is substantially the same as that of the aperture 14*a* and the aperture 24*a* of the circular nonwoven fabric 11 and the circular support plate 21. However, the shortest distance $L_3$ from the aperture 34*a* to the outer periphery is shorter than the distance $L_1$ and the distance $L_2$.

A circular nonwoven fabric 12 in FIG. 3B is used in combination with a circular support plate 22 in FIG. 4B, and, when necessary, is further used in combination with a circular plate 32 in FIG. 5B. The circular nonwoven fabric 12 has an aperture 14*b* in the center, the circular support plate 22 has an aperture 24*b* in the center, and the circular plate 32 has an aperture 34*b* in the center.

The aperture 14*b*, the aperture 24*b*, and the aperture 34*b* have substantially the same shape. In the nonwoven fabric polishing roll in which the circular support plates 22 are disposed at both ends of the polishing portion in which a plurality of each of the circular nonwoven fabric 12 and the circular plate 32 are stacked, the through hole into which the rotating shaft of the polishing machine is inserted is formed by the aperture 14*b*, the aperture 24*b*, and the aperture 34*b*. In other words, the aperture 14*b*, the aperture 24*b*, and the aperture 34*b* have substantially the same shape as the cross-sectional shape of the rotating shaft of the polishing machine, and they can each have key projections that engage with the key grooves on the rotating shaft.

The external diameter of the circular nonwoven fabric 12 and that of the circular support plate 22 are substantially the same, and the shortest distance $L_1$ from the aperture 14*b* to the outer periphery of the circular nonwoven fabric 12 and the shortest distance $L_2$ from the aperture 24*b* to the outer periphery of the circular support plate 22 are substantially the same length. On the other hand, the shape of the aperture 34*b* of the circular plate 32 is substantially the same as that of the aperture 14*b* and the aperture 24*b* of the circular nonwoven fabric 12 and the circular support plate 22. However, the shortest distance $L_3$ from the aperture 34*b* to the outer periphery is shorter than the distance $L_1$ and the distance $L_2$.

A circular nonwoven fabric 13 in FIG. 3C is used in combination with a circular support plate 23 in FIG. 4C, and, when necessary, is further used in combination with a circular plate 33 in FIG. 5C. The circular nonwoven fabric 13 has an aperture 14*c* in the center, the circular support plate 23 has an aperture 24*c* in the center, and the circular plate 33 has an aperture 34*c* in the center.

The aperture 14*c*, the aperture 24*c*, and the aperture 34*c* have substantially the same shape. In the nonwoven fabric polishing roll in which the circular support plates 23 are disposed at both ends of the polishing portion in which a plurality of each of the circular nonwoven fabric 13 and the circular plate 33 are stacked, the through hole into which the rotating shaft of the polishing machine is inserted is formed by the aperture 14*c*, the aperture 24*c*, and the aperture 34*c*. In other words, the aperture 14*c*, the aperture 24*c*, and the aperture 34*c* have approximately the same shape as the cross-sectional shape of the rotating shaft of the polishing machine. In the circular nonwoven fabric 13, the circular support plate 23, and the circular plate 33, the aperture 14*c*, the aperture 24*c*, and the aperture 34*c* have a hexagonal shape, so the circular nonwoven fabric 13, the circular support plate 23, and the circular plate 33 are used to manufacture nonwoven fabric polishing rolls for installation in a polishing machine comprising a rotating shaft with a hexagonal cross-sectional shape.

The shapes of the apertures of the circular nonwoven fabric 1, the circular support plate 2, and the circular plates 7 are not limited to the shapes illustrated in FIGS. 3, 4, and 5, but can be modified as appropriate in accordance with the shape of the rotating shaft of the polishing machine. For example, the shape of the apertures may be triangular, square, and the like, or they may have a shape to engage with a rotating shaft that has one or two or more key projections, or they may have a shape to engage with a rotating shaft with one or two or more key grooves.

The circular nonwoven fabric 1 includes, for example, a nonwoven fabric base material and polishing abrasive particles retained on the nonwoven fabric base material. The nonwoven fabric base material may be a nonwoven fabric constituted by organic fibers formed from a resin such as polyamide (for example, nylon (registered trademark) 6, nylon (registered trademark) 6, 6, and the like), polyolefin (for example, polypropylene, polyethylene, and the like), polyester (for example, polyethylene terephthalate, and the like), polycarbonate, and the like. The thickness (fiber diameter) of the organic fibers may be in a range from 19 to 250 μm, for example.

The polishing abrasive particles may be changed as appropriate in accordance with the object to be polished, and, for example, may be a ceramic abrasive particle such as SiC, $Al_2O_3$, $Cr_2O_5$, or the like. The diameter of the polishing abrasive particles may be changed as appropriate in accordance with the object to be polished, and, for example, may be from 0.1 to 1000 μm.

The circular nonwoven fabric 1 can be produced by, for example, impregnating a nonwoven fabric base material with a polishing compound containing the polishing abrasive particles, and drying and/or hardening.

Examples of polishing compound include the polishing abrasive particles and a binder polymer such as epoxy resin, phenol resin, or the like, and a solvent such as xylene, carbitol, or the like, for dissolving the binder polymer, and, if necessary, a hardening agent may be included in the polishing compound. After impregnating this polishing compound in the nonwoven fabric base material, the solvent is removed and the binder polymer is hardened in, for example, a heating furnace, so that the polishing abrasive particles are retained on the nonwoven fabric base material.

After the polishing abrasive particles are retained on the nonwoven fabric base material in a sheet form, the circular nonwoven fabric 1 can be obtained by, for example, carrying out a punching process on the nonwoven fabric base material in a sheet form to obtain individual members with the shape illustrated in FIGS. 3A-C. Also, the circular nonwoven fabric 1 can be obtained by causing the polishing abrasive particles to be retained on the nonwoven fabric base material that has been processed to the shape illustrated in FIGS. 3A-C or the like.

There is no particular limitation on the external diameter of the circular nonwoven fabric 1, but it can be for example, from 50 to 700 mm, or from 100 to 400 mm.

There is no particular limitation on the thickness of the circular nonwoven fabric 1, preferably, each of the plurality of circular nonwoven fabrics 1 have the same thickness, but they may have different thicknesses. The thickness of the circular nonwoven fabric 1 before stacking may be, for example, from 2 to 30 mm, or it may be from 5 to 20 mm.

The circular support plate 2 includes nonwoven fabric that is hardened in the compressed state, and may be the same nonwoven fabric described above for the nonwoven fabric base material.

The circular support plate 2 can be obtained by, for example, stacking a plurality of sheets of nonwoven fabric in a sheet form, hardening them while they are compressed in the stacking direction, and next a punching process is performed on the hardened nonwoven fabric to obtain individual members with the shape illustrated in FIGS. 4A-C. Also, the circular support plate 2 can be obtained by stacking and compressing in the stacking direction a plurality of nonwoven fabric that has been processed into the shape as illustrated in FIGS. 4A-C or the like.

Also, the circular support plate 2 may be obtained by stacking a plurality of nonwoven fabric base material of the circular nonwoven fabric 1, compressing it in the stacking direction, and hardening it, or the circular support plate 2 may be obtained by stacking a plurality of the circular nonwoven fabrics 1, compressing them in the stacking direction, and hardening it.

In a preferred form, the circular support plate 2 includes a laminate that has been hardened while compressed in the stacking direction, and the laminate includes a plurality of stacked circular nonwoven fabrics 1. There is no particular limitation on the number of the stacked circular nonwoven fabrics 1 in the laminate, for example, it can be selected as appropriate in order to satisfy the preferred thickness as described later and the preferred deformation rate as described above.

The nonwoven fabric in the circular support plate 2 can be hardened using an adhesive. Here, the adhesive may be, for example, an adhesive that includes a hardenable resin and a hardening agent.

The hardenable resin may be, for example, epoxy resin, urea resin, urethane resin, phenol resin, or the like. Of these, the epoxy resin may be a cresol novolac type epoxy resin, a bisphenol A type epoxy resin, a bisphenol F type epoxy resin, a phenol novolac type epoxy resin, a tris(hydroxyphenyl) methane type epoxy resin, a naphthalene type epoxy resin, a fluorene epoxy resin, a glycidylamine compound, and the like.

The hardening agent may be, for example, dicyandiamide (DICY), acid hydrazide, boron trifluoride complex, imidazole compound, amine imide, and lead salts, and, of these, dicyandiamide is particularly preferred.

In a preferred form, the nonwoven fabric included in the circular support plate 2 is hardened by an adhesive, and a content of the adhesive is in a range from 5 to 30 mass % of the total mass of the nonwoven fabric. The circular support plate 2 that includes such nonwoven fabric can easily satisfy the deformation rate as described above. Also, such a circular support plate 2 can have a sufficiently large amount of wear in the polishing process, so it is possible to perform the polishing process more efficiently.

The circular support plate 2 may also include polishing abrasive particles. In this case, the nonwoven fabric polishing roll 100 is capable of performing the polishing process over a width indicated by $W_2$ in FIG. 2.

When the circular support plate 2 includes polishing abrasive particles, preferably, the type and quantity of polishing abrasive particles are adjusted so that the same quantity of polishing can be obtained in the circular support plate 2 as the quantity of polishing in the polishing portion 50. As a result, when the polishing process is performed over the width indicated by $W_2$ in FIG. 2, it is possible to achieve uniform polishing over the whole area indicated by $W_2$.

From the perspective of more reliably and more uniformly polishing the object to be polished, and avoiding wear of the backup roll, preferably, the circular support plate 2 does not contain polishing abrasive particles, and polishing of the object to be polished is carried out over the width indicated by $W_1$ in FIG. 2. Also, in this case, the circular support plate 2 may include filling materials such as course polishing abrasive particles that do not substantially affect the polishing process, polishing abrasive particles with low polishing capability, other inorganic particles, or the like.

The external diameter of the circular support plate 2 is substantially the same as the external diameter of the circular nonwoven fabric 1, and it may be, for example, from 50 to 700 mm, or it may be from 100 to 400 mm.

The thickness of the circular support plate 2 is preferably in a range from 3 to 25% of the external diameter of the circular support plate 2, and more preferably in a range from 5 to 15%. According to this circular support plate 2, the effective polishing width of the nonwoven fabric polishing roll 100 (the width indicated by $W_1$ in FIG. 2) can be sufficiently ensured, and the spread in the stacking direction of the circular nonwoven fabric in the polishing portion can be more significantly suppressed.

There is no particular limitation on the circular plate 7 provided that it is harder than the circular nonwoven fabric 1 (the hardness measured using an Asker C durometer is higher than the hardness of the circular nonwoven fabric 1 prior to stacking). For example, high compression paper, hardboard, plastic board, paper impregnated with phenol resin, if necessary laminated and hardened (paper phenol substrate, bakelite board), fiber reinforced plastic (FRP), veneer board, particle board, metal plate, and the like, formed into the shape illustrated in FIGS. 5A-C can be used.

When polishing using the nonwoven fabric polishing roll 100, sometimes water is poured onto the surface of the object to be polished while polishing, for example, so preferably, the circular plate 7 has water resistance.

It is sufficient that the external diameter of the circular plate 7 be less than the external diameter of the circular nonwoven fabric 1. However, as stated above, preferably, the external diameter of the circular plate 7 is less than the external diameter of the flange 4, from the point of view of increasing the area that can be used for polishing, and because it is possible to easily confirm the limiting usable diameter by external visual observation.

For example, the shortest distance ($L_3$ in FIGS. 5A-C) from the aperture of the circular plate to the outer periphery of the circular plate 7 may be greater than or equal to 5 mm. By making the shortest distance $L_3$ 5 mm or more, it is possible to more significantly maintain the stability of the shape of the outer periphery of the polishing portion 50, and achieve more uniform polishing operations. Also, the shortest distance $L_3$ may also be in a range from 5 to 100 mm.

The thickness of the circular plate 7 can be, for example, from 1 to 5 mm. By making the thickness of the circular plate 7 in the above range, it is possible to ensure sufficient strength of the inner periphery of the polishing portion 50, and further significantly maintain the stability of the shape of the outer periphery.

Also, similar to the circular support plate 2, the circular plate 7 can include nonwoven fabric that has been hardened in the compressed state. Such a circular plate 7 can wear in the polishing process, together with the circular nonwoven fabrics 1, so, for example, even when the external diameter of the circular plate 7 is greater than the external diameter of the flange 4, it is possible to perform the polishing process until the external diameter of the circular plates 7 reaches the external diameter of the flange 4.

When the circular plate 7 includes nonwoven fabric that has been hardened in the compressed state, the type of nonwoven fabric and the type of adhesive used for hardening, and the like, can be the same as those examples described for the circular support plate 2. In other words, the circular plate 7 can have the same configuration as that of the circular support plate 2.

Figure 7:
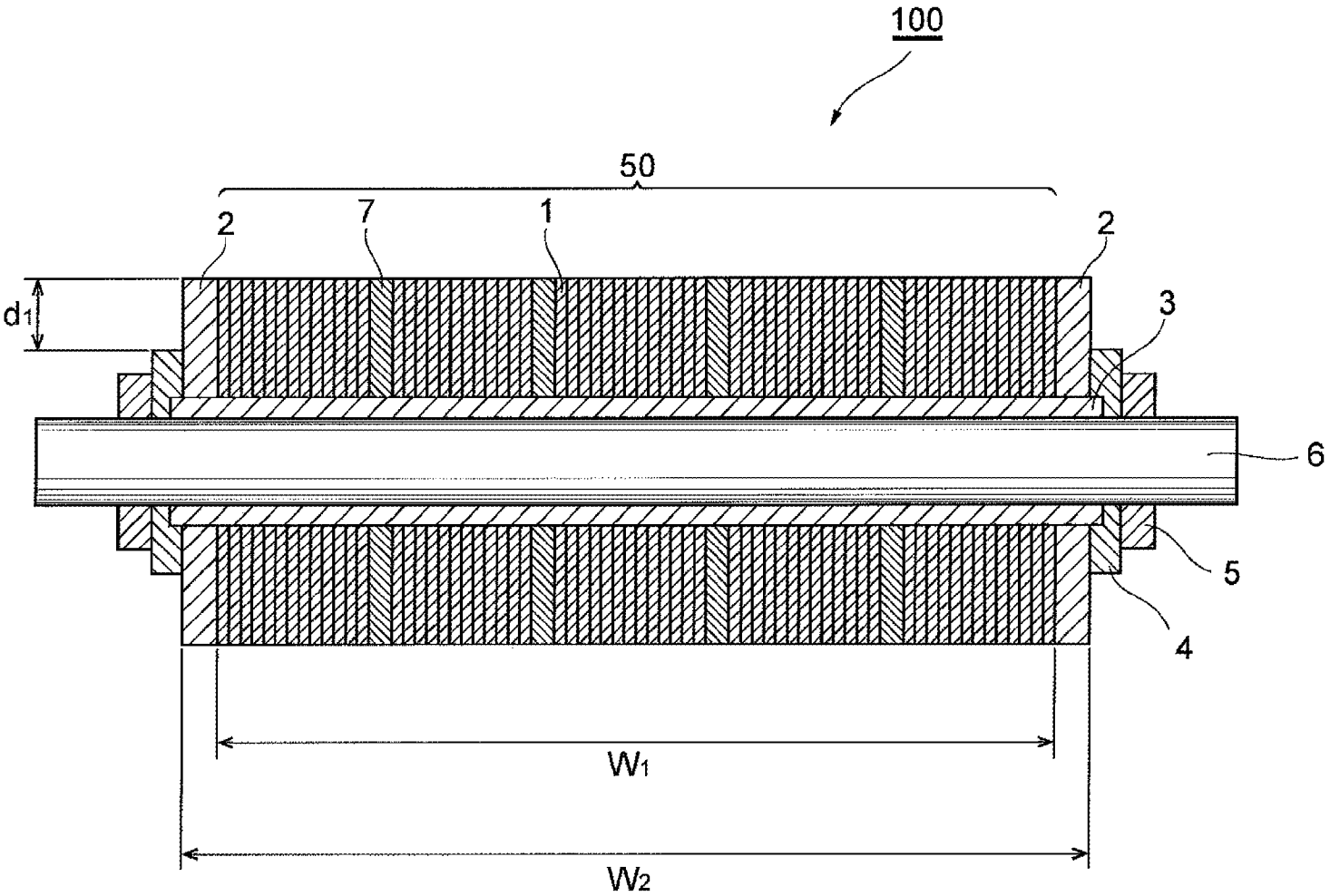
FIG. 7 is a schematic cross-sectional view illustrating an assembly with the rotating shaft inserted into the nonwoven fabric polishing roll according to an embodiment of the present invention.

Also, in this case, the circular plate 7 can wear together with the circular nonwoven fabric 1, so the external diameter of the circular plate 7 can be substantially the same as that of the circular nonwoven fabric 1, as illustrated in FIG. 7. In the form illustrated in FIG. 7, circular plates 7 having the external diameter substantially the same as that of the circular nonwoven fabric 1 are inserted at predetermined intervals, so the spread in the stacking direction in the polishing portion 50 is further significantly suppressed.

In the form illustrated in FIG. 7, the circular plate 7 includes polishing abrasive particles, and together with the circular nonwoven fabric 1 constitutes the polishing portion 50. The type and quantity of polishing abrasive particles contained in the circular plate 7 can be adjusted so that uniform polishing in all areas of the polishing portion 50 is enabled, and so that the same amount of polishing can be obtained as from the portion constituted from the circular nonwoven fabric 1.

In the form illustrated in FIG. 7, the thickness of the circular plate 7 can be, for example, from 3 to 25 mm, or from 5 to 10 mm. Also, the circular plate 7 may have the same shape as the circular support plate 2.

Figure 6A:
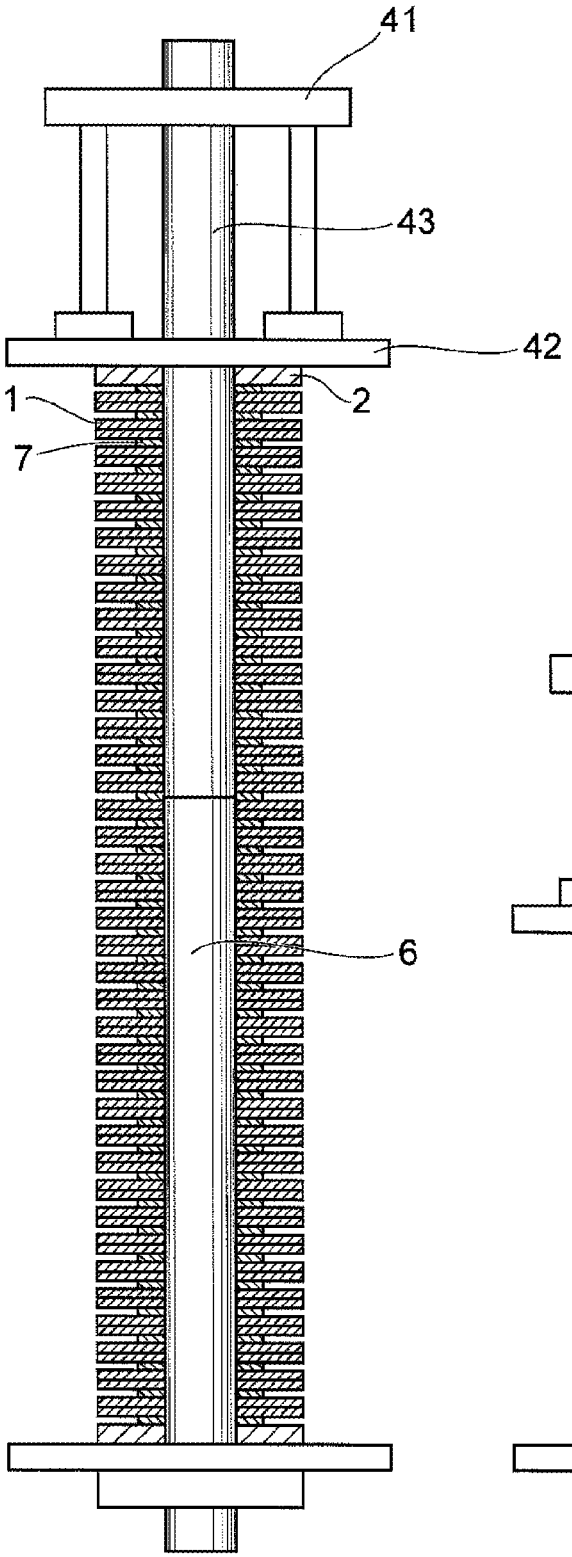
FIGS. 6A-B illustrate an example of a manufacturing method for the nonwoven fabric polishing roll according to an embodiment of the present invention.
Figure 6B:
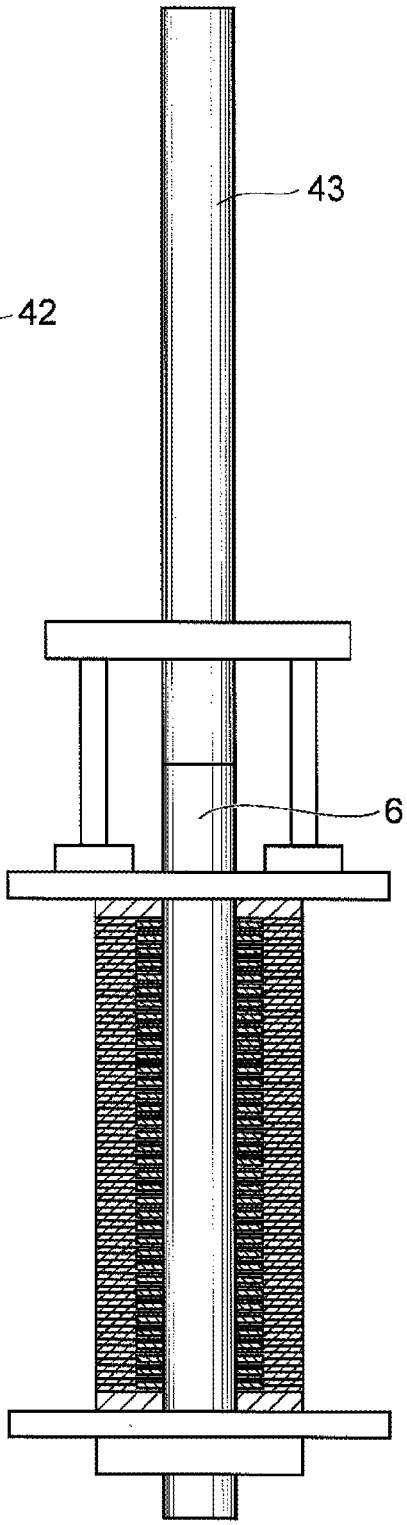

FIGS. 6A-B are schematic cross-sectional views illustrating examples of a manufacturing process of the nonwoven fabric polishing roll 100.

In the manufacturing process, as illustrated in FIG. 6A, first two circular support plates 2, the plurality of circular nonwoven fabrics 1, and the plurality of circular plates 7 are stacked with each member in the same positional relationship in the nonwoven fabric polishing roll 100. Here, it is necessary that the circular support plate 2, the circular nonwoven fabric 1, and the circular plate 7 are stacked so that their respective apertures form the through hole that engages with the rotating shaft. Therefore, in the manufacturing process, the rotating shaft 6 and a dummy shaft 43 with the same shape as the rotating shaft 6 are used as the shaft, and the circular support plate 2, the circular nonwoven fabric 1, and the circular plate 7 are stacked by inserting them thereon.

The circular support plate 2, the circular nonwoven fabrics 1, and the circular plates 7 that are stacked using the rotating shaft 6 and the dummy shaft 43 as the shaft are retained at both ends in the stacking direction by a retaining fixture 42. Here, the retaining fixture 42 is provided with a through hole in the center into which the dummy shaft 43 is inserted so that the retaining fixture 42 can move freely in the stacking direction (the axial direction of the dummy shaft 43).

Next, the circular support plate 2, the circular nonwoven fabrics 1, and the circular plates 7 are compressed in the stacking direction via the retaining fixture 42 using compression means 41 installed at one of the retaining fixtures 42, to form the compressed laminate as illustrated in FIG. 6B.

Then, the compressed laminate illustrated in FIG. 6B is fixed to the rotating shaft 6 using the flange 4 and the lock nut 5, and finally the retaining fixture 42 is removed, to obtain the nonwoven fabric polishing roll 100 as illustrated in FIG. 1 and FIG. 2.

A roll assembly according to this embodiment includes the nonwoven fabric polishing roll 100, the rotating shaft 6 that is inserted into the through hole, and two flanges 4 that join the rotating shaft 6 and the nonwoven fabric polishing roll 100 at both ends of the nonwoven fabric polishing roll 100.

Also, the polishing machine according to this embodiment includes the nonwoven fabric polishing roll 100, and preferably includes the above-described roll assembly. Apart from the nonwoven fabric polishing roll 100, the configuration of the polishing machine according to this embodiment can be the same as that of a polishing machine that includes a conventional polishing roll.

Also, according to this embodiment, using a polishing method that includes a step of bringing an object to be polished into contact with the polishing portion 50 of the nonwoven fabric polishing roll 100 that is rotated by the rotating shaft 6, the object to be polished is polished, and it is possible to manufacture a polished product.

There is no particular limitation on the object to be polished, for example, it may be metal strip or metal plate, or the like. Also, as described above, the nonwoven fabric polishing roll 100 can be ideally applied to polishing under low polishing load conditions with polishing loads in a range from 0.1 to 10 kgf/cm (preferably from 0.5 to 5 kgf/cm). The object to be polished with this type of polishing can include, for example, metal strip of copper, iron, aluminum, and alloys thereof.

Also, an example of polishing that applies the nonwoven fabric polishing roll 100 according to this embodiment includes, in the manufacturing process of steel, brass, and copper materials, polishing to remove the oxide film remaining on the surface after rolling, annealing, and pickling of the metal strip. In this type of polishing, the metal strip is continuously polished, so continuous stable polishing performance and a uniform finish across the width are required. According to the nonwoven fabric polishing roll 100 of this embodiment, it is possible to sufficiently satisfy the properties required for this type of polishing.

In the above the preferred embodiments of the present invention were explained, but the present invention is not limited to these embodiments.

EXAMPLES

In the following, a specific explanation of the present invention is provided based on the details of confirmation tests that were performed on nonwoven fabric polishing rolls according to the embodiments as described above. However the present invention is not limited to these working examples.

Comparative Example 1

Seventy six pieces of circular nonwoven fabric were produced by punching nonwoven fabric polishing sheet with a basis weight of 740 g/m$^2$ (with polishing abrasive particles retained on the nonwoven fabric base material) to an external diameter of 210 mm and an internal diameter of 76 mm. Also, 18 circular plates having an external diameter of 135 mm made from high compression paper (a paper and plastic hybrid material) were prepared.

The 76 pieces of circular nonwoven fabric and the 18 circular plates were stacked so that for each 4 pieces of circular nonwoven fabric stacked one circular plate was stacked. After stacking, 135 mm external diameter steel flanges were placed at both ends, and the flanges were compressed until the interval between the flanges was 190 mm, and this interval was held. Next, dressing was carried out so that the overall external diameter was 200 mm. Finally, the circular nonwoven fabric that had spread to the outer side of the flanges and could not maintain the external diameter of 200 mm was removed with an end surface process. The removed circular nonwoven fabric was 3 pieces at each end, or a total of 6 pieces.

The obtained nonwoven fabric polishing roll included 70 pieces of circular nonwoven fabric in the outer periphery of the polishing portion, and the roll width was 215 mm. Also, the design dimensions of the nonwoven fabric polishing roll were a thickness of 2 5 mm per circular nonwoven fabric (roll width: 190 mm/76 pieces), and the thickness per circular nonwoven fabric in the nonwoven fabric polishing roll obtained was 3.07 mm (roll width: 215 mm/70 pieces).

Working Example 1

Nonwoven fabric base material with a basis weight of 360 g/m$^2$ (impregnated with an adhesive to 8 mass % of the nonwoven fabric) was punched to an external diameter of 210 mm and an internal diameter of 76 mm, to produce 10 pieces of nonwoven fabric disk. Next, the 10 pieces of nonwoven fabric disk were stacked and compressed to maintain a width of 20 mm, and a circular support plate A1 was produced by bonding between the disks by high temperature heat treatment. One more circular support plate A1 was produced by the same method.

Nonwoven fabric polishing sheet with a basis weight of 740 g/m$^2$ (with polishing abrasive particles retained on the polishing abrasive particles) was punched to an external diameter of 210 mm and an internal diameter of 76 mm, to produce 60 pieces of circular nonwoven fabric. Also, 14 circular plates having an external diameter of 135 mm made from high compression paper were prepared.

The 60 pieces of circular nonwoven fabric and the 14 circular plates were stacked between the two circular support plates A1 so that for each 4 pieces of circular nonwoven fabric stacked one circular plate was stacked. At both ends 135 mm external diameter steel flanges were placed, and the flanges were compressed until the interval between the flanges was 190 mm, and this interval was held. Finally, the whole was dressed to an external diameter of 200 mm, to obtain the nonwoven fabric polishing roll.

The design dimensions of the width of the polishing portion of the nonwoven fabric polishing roll (the width indicated by $W_1$ in FIG. 2) and the roll width (the width indicated by $W_2$ in FIG. 2) were 150 mm and 190 mm respectively, and the roll widths of the nonwoven fabric polishing rolls obtained were 175 mm and 215 mm. Also, the design dimension of the thickness of the circular nonwoven fabric on the outer periphery of the polishing portion was 2.5 mm (roll width: 190 mm/76 pieces), and in the nonwoven fabric polishing roll obtained, the thickness was 2.92 mm (roll width: 215 mm/76 pieces).

Working Example 2

Nonwoven fabric base material with a basis weight of 360 g/m2 (impregnated with adhesive to 8 mass % of the nonwoven fabric) was punched to an external diameter of 210 mm and an internal diameter of 76 mm, to produce 16 pieces of nonwoven fabric disk. Next, the 16 pieces of nonwoven fabric disk were stacked and compressed to maintain a width of 20 mm, and a circular support plate A2 was produced by bonding between the disks by high temperature heat treatment. One more circular support plate A2 was produced by the same method.

A nonwoven fabric polishing roll was obtained in the same manner as for Working Example 1, except that the circular support plate A1 in Working Example 1 was changed to the circular support plate A2.

The design dimensions of the width of the polishing portion of the nonwoven fabric polishing roll and the roll width were 150 mm and 190 mm respectively, and the roll widths of the nonwoven fabric polishing rolls obtained were 163 mm and 200 mm. Also, the design dimension of the thickness of the circular nonwoven fabric on the outer periphery of the polishing portion was 2.5 mm (roll width: 190 mm/76 pieces), and in the nonwoven fabric polishing roll obtained, the thickness was 2.63 mm (roll width: 200 mm/76 pieces).

(Measurement of Hardness Distribution)

The hardness distribution for the 150 mm center portion of the roll width of the nonwoven fabric polishing rolls obtained for Working Examples 1 and 2 and Comparative Example 1 were measured. Specifically, for the 150 mm center portion of the roll width of the nonwoven fabric polishing rolls, the hardness was measured on the outer periphery at 25 mm interval using an Asker C durometer.

The measurement results for the polishing roll in Comparative Example 1 showed that the hardness reduced significantly toward both ends caused by spread in the stacking direction of the circular nonwoven fabric. In contrast, a comparatively high hardness was maintained at positions close to both ends in the polishing roll according to Working Example 1. Also, the polishing roll according to Working Example 2 had a hardness that was overall higher compared with both Comparative Example 1 and Working Example 1, and the high hardness was also maintained at positions close to both ends.

(Polishing Tests)

When polishing tests were performed for the surface finish of copper plates using a plane polishing machine, a polished surface with sufficient uniformity was obtained with the polishing roll according to Working Example 1, and a polished surface with even higher uniformity was obtained with the polishing roll according to Working Example 2. On the other hand, with the polishing roll according to Comparative Example 1, it was not possible to perform sufficient polishing at both ends of the polishing rolls, so it was not possible to obtain a uniform finish.

(Deformation Rate of the Circular Support Plate)

In the polishing portions of the polishing rolls according to Working Examples 1 and 2, after dressing, 60 pieces of circular nonwoven fabric having an external diameter of 200 mm and an internal diameter of 76 mm were stacked. At this time, the compressive stress $T_1$ applied from the polishing portion to the circular support plates was estimated to be 4570 N. Also, in Working Examples 1 and 2, flanges having an external diameter of 135 mm and an internal diameter of 76 mm were used, so the compressive stress per unit area $T_1/S_1$ applied to a portion where the circular support plate and the flange were in contact was 47 N/cm$^2$.

Figure 9:
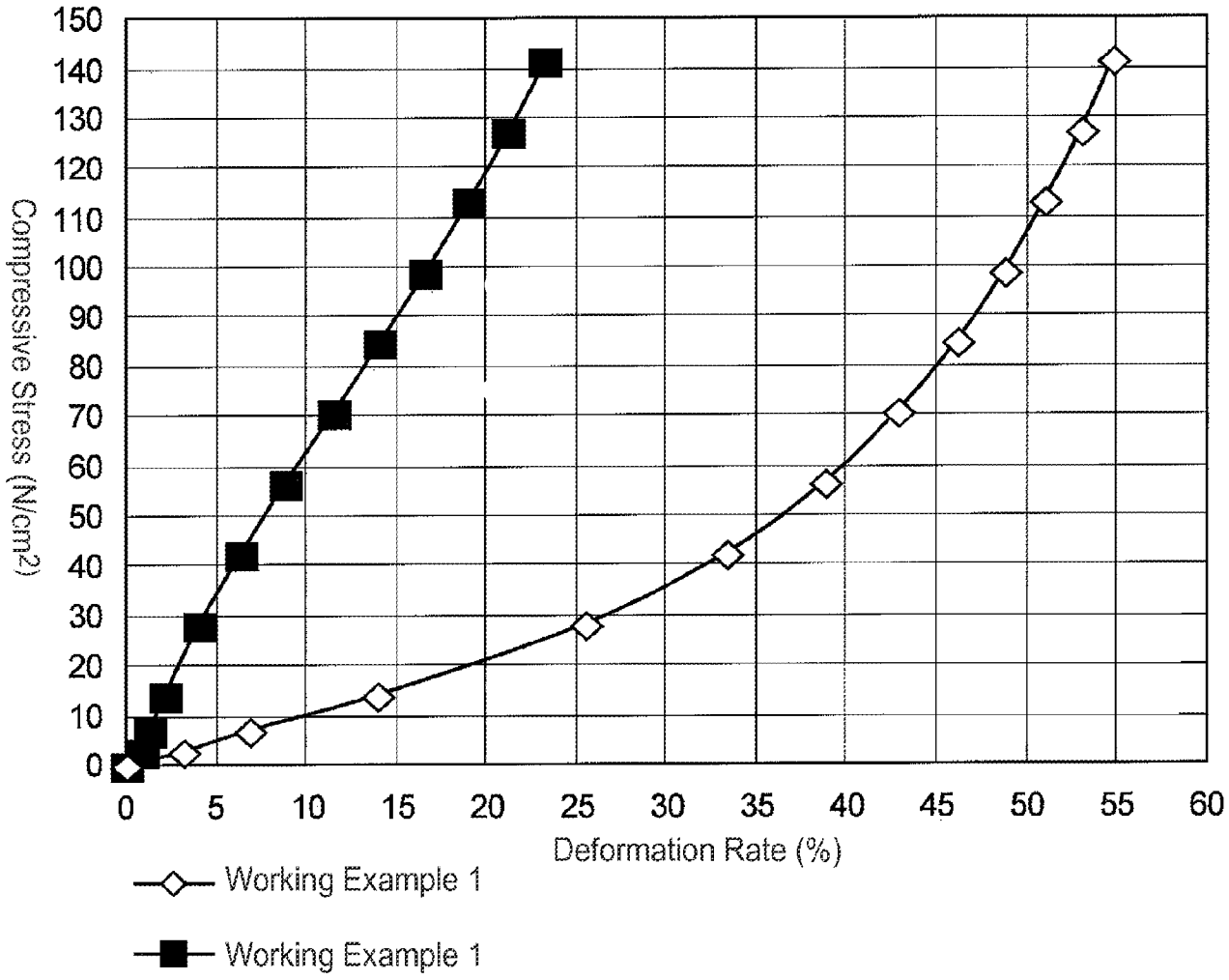
FIG. 9 shows a relationship between a compressive stress and a deformation rate of the circular support plate of working examples.

Here, FIG. 9 shows the results of the deformation rate with respect to the compressive stress for circular support plate A1 of Working Example 1 and circular support plate A2 of Working Example 2.

From the results in FIG. 9, in Working Example 1, the deformation rate of circular support plate A1 with respect to a compressive stress of 47 N/cm$^2$ was 35%. Also, in Working Example 2, the deformation rate of circular support plate A2 with respect to a compressive stress of 47 N/cm$^2$ was 7%.

According to the present invention, it is possible to provide a nonwoven fabric polishing roll that is capable of highly efficient and uniform polishing over a long period of time, a circular support plate to achieve this nonwoven fabric polishing roll, a roll assembly that includes the nonwoven fabric polishing roll, and a polishing method using the roll assembly, so the present invention is useful industrially.

What is claimed is:

1. A nonwoven fabric polishing roll having a through hole into which a rotating shaft of a polishing machine is inserted, comprising:

a polishing portion formed by stacking a plurality of circular nonwoven fabrics having an aperture that forms the through hole; and two circular support plates located one at each of both ends in the stacking direction of the polishing portion, having an aperture that forms the through hole, and having an external diameter that is substantially the same as that of the circular nonwoven fabric;

wherein, the circular support plates include nonwoven fabric that is hardened in a compressed state.

2. The nonwoven fabric polishing roll according to claim 1, wherein: an area of the circular support plate contacting a flange that joins the nonwoven fabric polishing roll and the rotating shaft is $S_1$ (m$^2$), compressive stress applied from the polishing portion is $T_1$ (N), and a deformation rate, calculated therefrom, in the thickness direction of the circular support plate with respect to the compressive stress per unit area $T_1/S_1$ (N/m$^2$) is not more than 20%.

3. The nonwoven fabric polishing roll according to claim 1, wherein: the nonwoven fabric included in the circular support plate is hardened by an adhesive, and a content of the adhesive is in a range from 5 to 30 mass % of the nonwoven fabric.

4. The nonwoven fabric polishing roll according to claim 1, wherein a thickness of the circular support plate is in a range from 3 to 25% of the external diameter of the circular support plate.

5. The nonwoven fabric polishing roll according to claim 1, wherein the circular support plate includes a laminate that has been hardened while compressed in the stacking direction, and the laminate includes a plurality of stacked circular nonwoven fabrics.

6. The nonwoven fabric polishing roll according to claim 1, wherein the polishing portion includes a plurality of stacked circular plates having an aperture that forms the through hole, and an external diameter that is not greater than the external diameter of the circular nonwoven fabrics.

7. The nonwoven fabric polishing roll according to claim 6, wherein: the circular plate comprises a nonwoven fabric that is hardened in a compressed state, and the external diameter of the circular plate is substantially the same as the external diameter of the circular nonwoven fabrics.

8. A roll assembly comprising: a nonwoven fabric polishing roll described in claim 1;

a rotating shaft that is inserted into the through hole; and two flanges that join the rotating shaft and the nonwoven fabric polishing roll at both ends of the nonwoven fabric polishing roll.

9. A circular support plate located at an end portion of a polishing portion in a nonwoven fabric polishing roll that includes a polishing portion formed by stacking a plurality of circular nonwoven fabrics having an aperture that forms a through hole into which a rotating shaft of a polishing machine is inserted, wherein the circular support plate comprises an aperture that forms the through hole, the circular support plate has an external diameter that is substantially the same as that of the circular nonwoven fabrics, and the circular support plate includes a nonwoven fabric that is hardened in a compressed state.

10. A polishing method comprising a step of: bringing an object to be polished into contact with the polishing portion of the roll assembly described in claim 8, which is rotated by the rotating shaft.

* * * * *